United States Patent [19]

Burger et al.

[11] Patent Number: 4,660,346

[45] Date of Patent: Apr. 28, 1987

[54] FRAME SYSTEM, ESPECIALLY FOR RACKS AND INTERIOR FIXTURES

[76] Inventors: Frank Burger, Keplerstrasse 22, D-8000 Munich 80, Fed. Rep. of Germany; Thomas Herzog, Imhofstrasse 8, D-8000 Munich 40, Fed. Rep. of Germany

[21] Appl. No.: 758,418

[22] Filed: Jul. 24, 1985

[30] Foreign Application Priority Data

Jul. 27, 1984 [DE] Fed. Rep. of Germany ..... 3427816
Oct. 8, 1984 [DE] Fed. Rep. of Germany ..... 3436882

[51] Int. Cl.[4] ..... E04H 12/00

[52] U.S. Cl. ..... 52/648; 52/653; 52/693

[58] Field of Search ..... 52/693, 696, 653, 652, 52/654, 655, 648

[56] References Cited

U.S. PATENT DOCUMENTS

| | | | |
|---|---|---|---|
| 1,212,759 | 1/1917 | Frost | 52/653 |
| 1,613,788 | 1/1927 | Dawson | 52/648 |
| 3,226,904 | 1/1966 | Itoh | 52/655 |
| 3,345,793 | 10/1967 | Cuikl | 52/693 |
| 3,407,560 | 10/1968 | Baumann | 52/648 |

FOREIGN PATENT DOCUMENTS

| | | | |
|---|---|---|---|
| 999416 | 11/1976 | Canada | 52/648 |
| 79155 | 7/1950 | Czechoslovakia | 52/655 |
| 2220683 | 10/1980 | Fed. Rep. of Germany . | |
| 1234093 | 10/1960 | France | 52/655 |
| 1582040 | 9/1969 | France | 52/648 |
| 927928 | 5/1982 | U.S.S.R. | 52/648 |

*Primary Examiner*—Henry E. Raduazo
*Attorney, Agent, or Firm*—Cushman, Darby & Cushman

[57] ABSTRACT

The frame system, especially for racks and interior fixtures comprises elongate lattice girders, including three chords not disposed in one plane and interconnected in transverse direction by ties. The ties are so arranged with respect to the chords that their legs define the sides of regular pyramids having square bases. Each of the pyramid surfaces is suitable for the connection of two lattice girders.

19 Claims, 46 Drawing Figures

FIG. 17
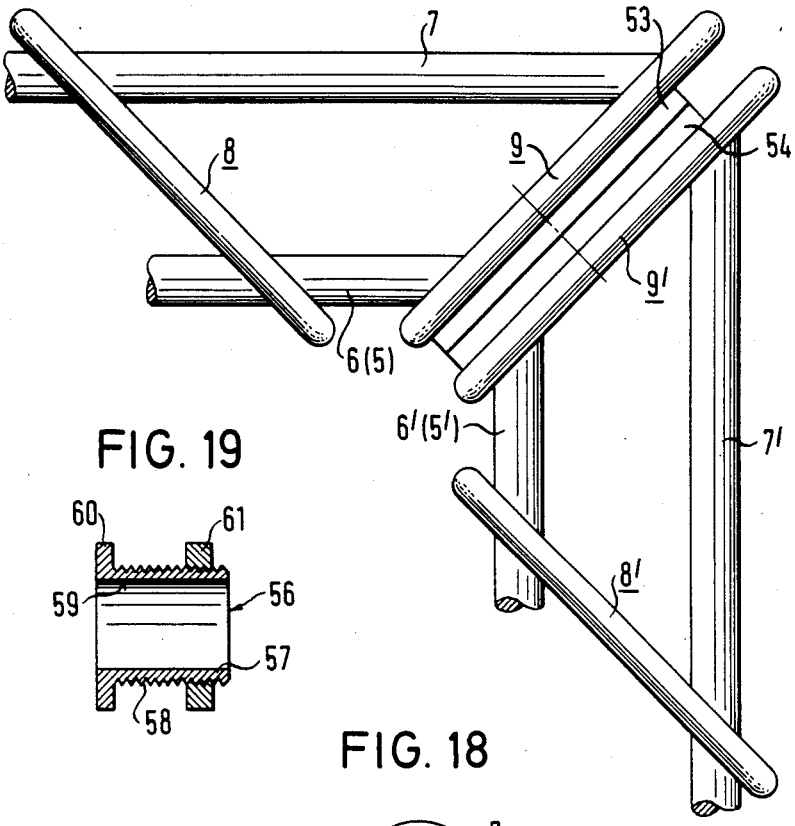
FIG. 19
FIG. 18
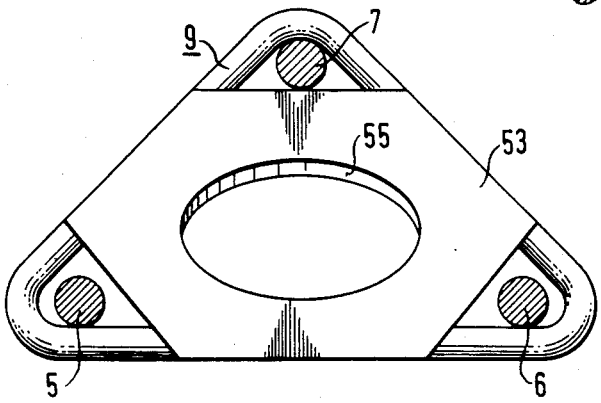

FRAME SYSTEM, ESPECIALLY FOR RACKS AND INTERIOR FIXTURES

The invention relates to a frame system, especially for racks and interior fixtures, comprising elongate lattice girders which include three ledgers (chords) not disposed in one plane and interconnected in transverse direction by ties, at least some of which are inclined with respect to the longitudinal axis of the chords and embrace the chords from the outside, connecting means being provided to connect contiguous lattice girders.

Such a frame system is known from DE-PS No. 22 36 086. With this frame system the chords are embodied by double bars extending parallel to each other so that fastening means, like angular pieces may be screw-connected between these double bars. Some of the ties are inclined with respect to the chords in order to increase the stability, as is known from framework girders. The face-end ties, however, are positioned at right angles with respect to the chords so that only a butt connection is possible with other lattice girders. For lateral fixing, additional chords are provided in the form of double bars, each joined to the bisector of the sides of the ties. Therefore, a total of six chords are provided as double bars. This requires a lot of material, increases the weight of the lattice girders, and gives them a confusing appearance.

DE-PS No. 890 860 discloses a triangular girder comprising three chords and "ties" which are embodied by planar, triangular plates having a central recess and holes in the range of their corners through which the chords are passed. The plates are inclined alternatingly at positive and negative angles with respect to the chords, adjacent plates contacting each other at their points or bases, respectively. This triangular girder is a special type of chord or boom girder and offers no possibility of joining several such girders in a frame rack.

It is an object of the invention to improve the frame system mentioned initially such that elements of simple structure may be assembled easily to provide frames which, moreover, are distinguished by their esthetic appearance. It is another object to provide a frame system of the kind specified in the interior of which electric cables and the like may be laid. Yet another object resides in providing a frame system of the kind recited which is flexible in that it permits assembling a great variety of different frames from basic elements.

This object is met, in accordance with the invention, in that the ties are closed triangles which are integrally formed and each defines a plane, in that the center lines of the legs of adjacent ties define side surfaces of regular four-sided pyramids, and in that the center lines of the legs of face-end ties also define a side surface of an identical pyramid so that at least the ties at face-end connecting surfaces and the ties at lateral connecting surfaces are inclined, the latter being inclined in opposed sense (by positive and negative angles).

Advantageous modifications and further developments of the invention may be gathered from the subclaims.

The frame system of the invention permits two different basic types of connection or joining of lattice girders, namely a face-end connection with which the two (triangular) ties at the face ends are positioned opposite each other and, on the other hand, a connection of one face end of a lattice girder with a "side" of another lattice girder. In the latter case two adjacent ties of the lattice girder to which the other one is to be joined at the side also form a triangle which is located opposite the face-end triangle of the other lattice girder. In both cases the joined lattice girders enclose an angle of 90°, the "connecting surfaces" lying exactly in the angle bisector of the connection.

It is the essence of this connection that two adjacent ties each define a regular pyramid the surfaces of which are inclined preferably by 45° with respect to the central vertical axis of the pyramid. It is to be imagined that in longitudinal direction of the chords the pyramids are tilted alternatingly by 180°, i.e. nested into each other. Each "pyramid surface" may become a connecting surface. In the plane of the pyramid surfaces the triangles defining the pyramid surfaces have a base angle of about 54.74° or, more accurately of atn $\sqrt{2}$. Accordingly, the point angle of the triangles is 70.53° or, more accurately, 180−2 atn. $\sqrt{2}$. This applies to the tilting angle mentioned of 45°.

As adjacent ties do not contact each other, the points of the triangle or the vertex of the pyramid are "dissociated" a condition obtained by imagining the tips of the ties to be cut off. If ties are used which are made of bent wire, this is realized by selecting a corresponding bending radius. Upon mathematically correct interpretation, however, the center lines of four tie sides each intersect in a point (vertex of the pyramid).

On the other hand, it is remarkable that the center lines of the ties and the center lines of the chords do not intersect. Although this slightly diminishes the stability of the lattice girders, it is in this way that a great variety is achieved of possibilities of interconnection.

The individual ties preferably are made of bent wire, the wire ends being butt-joined, preferably by welding. Thus only one tie form is needed, and this permits mass production by one machine. The connection between ties and chords, the latter preferably being elongate wire rods, preferably is made by welding. An especially simple manner of realizing that being electric resistance welding.

The invention offers three basic variants for connecting lattice girders (each variant including a number of sub-variants). The first variant resides in directly joining contiguous ties, such as by clamping or bracing members or by welding. With the second variant, plate-like structural members are mounted at the "surfaces" to be joined, and these plates are interconnected, for instance by threaded or bayonet-type connections or the like.

The third variant provides for use of double ties in the area of the joint, with a spacing between the double ties for passage of connecting means, such as screws.

As there is a spacing between adjacent ties, supporting or connecting members may be placed in this spacing, and this permits composing even complicated lattice networks which are suitable for being supported or suspended.

Fields of application of the instant invention, above all, are shelves, chairs, tables, floor lamps, and arms for suspended room ceiling structures, like lamps, loudspeakers, or decorations attached to ceilings of greater halls, and also cable chutes or desk storage bins.

The invention will be described further, by way of example, with reference to the accompanying drawing, in which:

FIG. 17 is a side elevation of a face-end connection, using two connecting possibilities according to FIG. 16;

FIG. 18 is a view similar to FIG. 16;

FIG. 19 is a presentation of a connecting sleeve used with the connection according to FIGS. 17 and 18;

Figure 1:
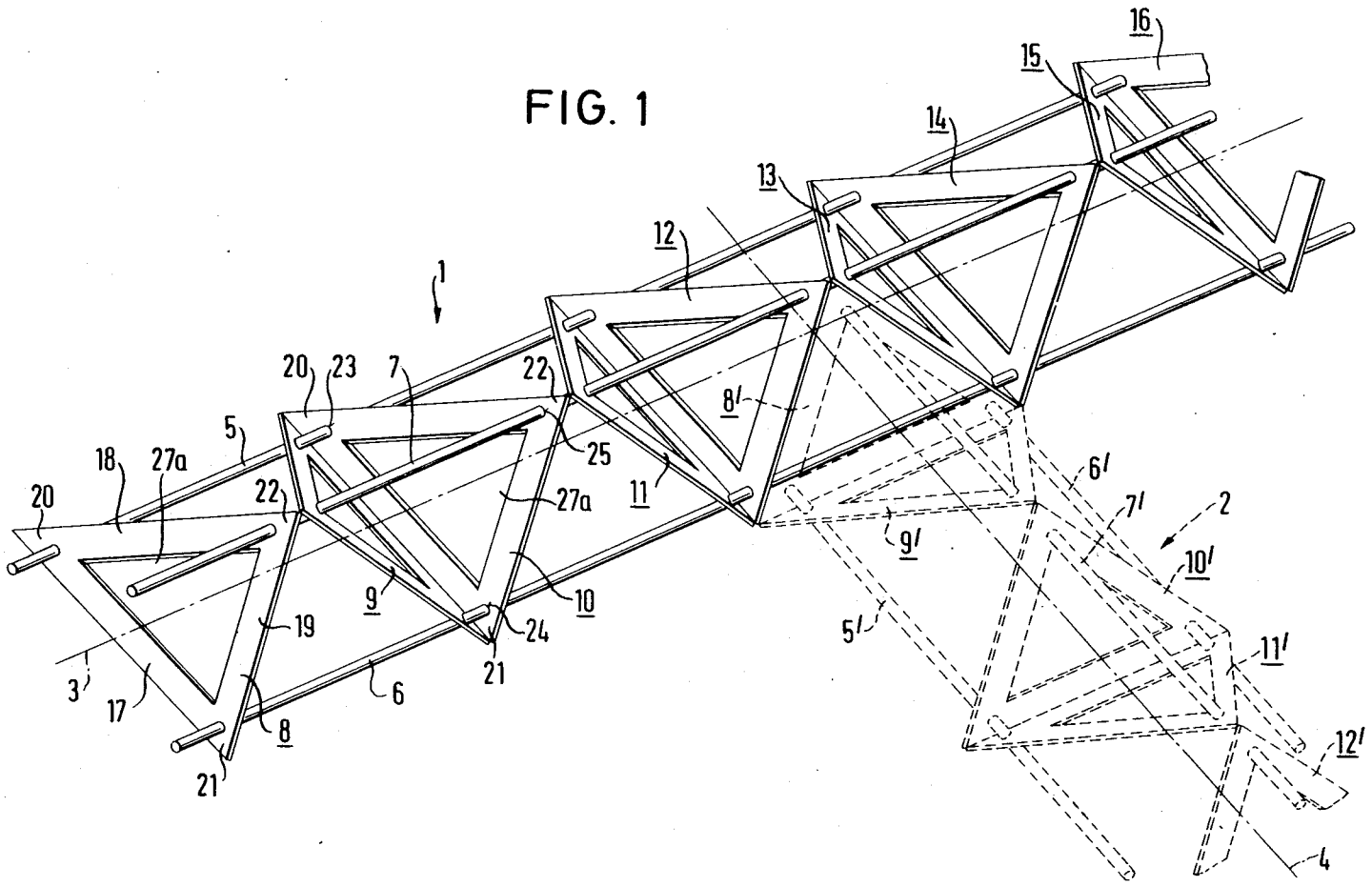
FIG. 1 is an inclined view of the frame system according to one embodiment of the invention, showing a lateral connection of two lattice girders.

FIGS. 27*a–f* show various variants of arrangements of the ties;

FIGS. 28*a–n* show examples of various frames composed in accordance with the invention.

In the various figures like reference numerals designate like or corresponding members.

First of all, reference is made to FIG. 1. This figure shows two lattice girders 1 and 2 connected to each other such that the longitudinal axes 3 and 4 of the lattice girders 1 and 2 extend at right angles with respect to each other. Each lattice girder has three ledgers or chords 5, 6, and 7 or 5′, 6′, 7′ interconnected by ties 8 to 16 or 8′ to 12′. The ties in this case are embodied by planar plates having a recess in the middle so as to form planar, isosceles triangles. A more detailed explanation will be given with reference to FIG. 3. The individual triangles 8 to 16 or 8′ to 12′ each are inclined alternatingly by +45° or −45° with respect to the central axis 3 or 4.

Two chords 5 and 6 or 5′ and 6′ lie in one plane and are interconnected by the base (e.g. 17) of the ties. The third chord 7 or 7′ lies above the plane of chords 5 and 6, exactly above the center line 3 or 4. In other words, the triangles formed by the ties are isosceles triangles (cf. legs 18 and 19).

In FIG. 1 adjacent ties (such as ties 8 and 9) each form a pyramid. The basis of this pyramid is defined by the bases (e.g. 17) of the triangles 8 and 9 and the corresponding portions of chords 5 and 6. The respective identical "side surfaces" of the pyramid are defined by the triangles formed by the sides of the two ties 8 and 9 and by the surfaces defined between the two triangles 8 and 9. It is important that all four side surfaces of the pyramid are identical. This permits a side connection, such as shown between the ties 12 and 13 of the lattice girder 1 and the tie 8′ of the lattice girder 2. The "pyramid surface" formed by the tie 8′ is exactly conform with the pyramid surface lying between the ties 12 and 13. Consequently this is a regular pyramid having a square base.

In the embodiment shown in FIG. 1 the ties each have holes 23, 24, 25 in the area of their corners 20, 21, and 22, respectively, and the chords 5, 6, 7 pass through the same. Of course, the same applies to all other ties as well. To increase the stability, the chords 5, 6, and 7 are fixed in addition in the holes, such as by cementing or welding.

Figure 2:
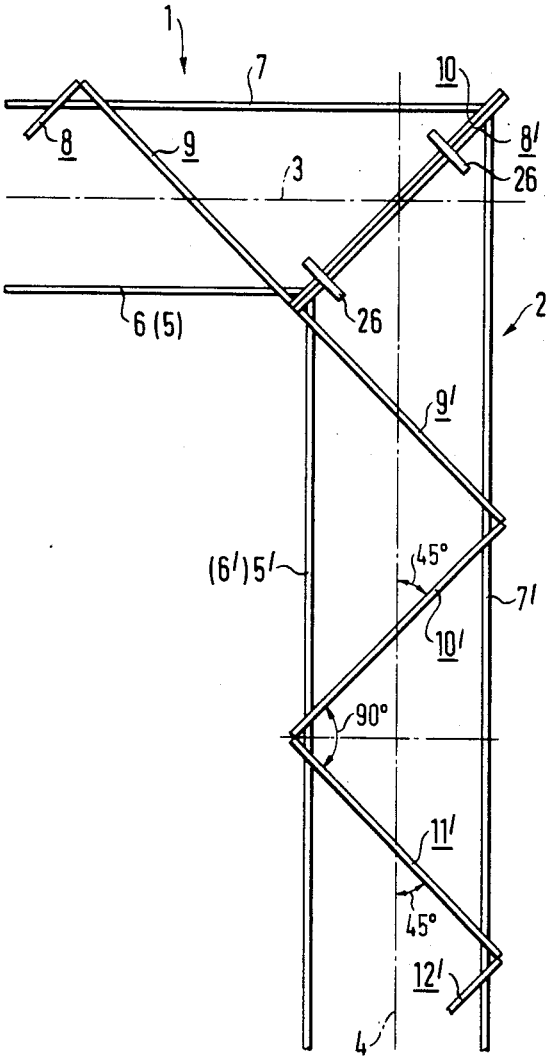
FIG. 2 is a side elevational view of the frame system, showing a face-end connection of two lattice girders.
Figure 3:
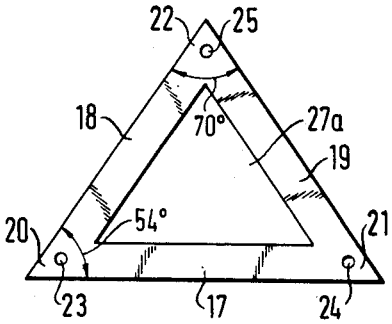
FIG. 3 is a top plan view of a tie for use with the embodiment of FIGS. 1 and 2.

FIG. 2 shows a face-end connection of lattice girders 1 and 2. Here the lattice girders 1 and 2 each are cut off in the corners defined by the ties 10 and 8′, respectively, which ties abut each other in planar engagement. Thus the center axes 3 and 4 are perpendicular with respect to each other. The two ties 10 and 8′ are fixed to each other by connecting members 26 (cf. FIG. 4). Furthermore, as shown more clearly in FIG. 2, the individual ties (e.g. 10′ and 11′) include an angle of 45° with the center axis (as seen in side projection). The alignment of the angle is in contrary sense whereby alternating angles of +45° and −45° are formed. The contiguous points of adjacent triangles thus include an angle of 90°. FIG. 3 shows a tie in top plan view. The legs 17, 18, and 19 of the triangle formed by the tie constitute an equilateral triangle, the angle between the base 17 and the legs 18 and 19 each being 54.74° (exactly: atn $\sqrt{2}$) and the point angle between the legs 18 and 19 consequently being 70.53° (180−2 atn $\sqrt{2}$).

This results in the following ratios of lengths of the sides: If the base 17 has a length "1", the length of legs 18 and 19 will be 0.866 or, more accurately, $\sqrt{0.75}$.

FIG. 3 further shows the location of the holes 23, 24, and 25 in the range of the corners 20, 21, and 22. Finally it is to be seen that the ties have a central recess 27*a*, in this case of triangular shape.

Adjacent ties may be connected in many different ways. For instance, with the connection shown in FIG. 2 the ties 10 and 8′ may be braced by connecting members 26. Furthermore, the legs 17, 18, and 19 may be formed with holes so that the ties 10 and 8′ can be screwed together. It is also possible to connect the legs by welding.

Figure 4:
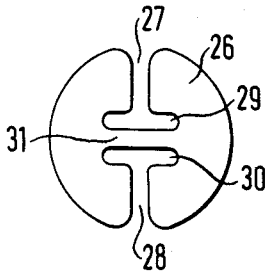
FIG. 4 is a top plan view of a connecting member for use with the embodiment according to FIGS. 1 to 3.
Figure 5:
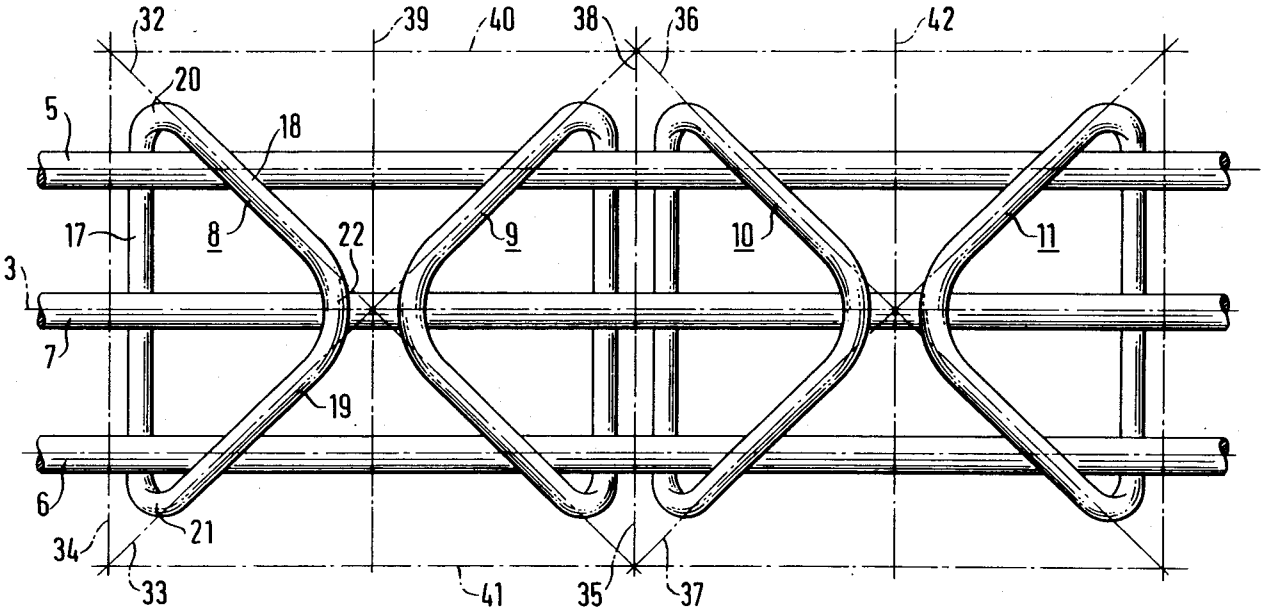
FIG. 5 is a top plan view (from above) of a lattice girder for the frame system of the invention in accordance with another embodiment of the invention.
Figure 6:
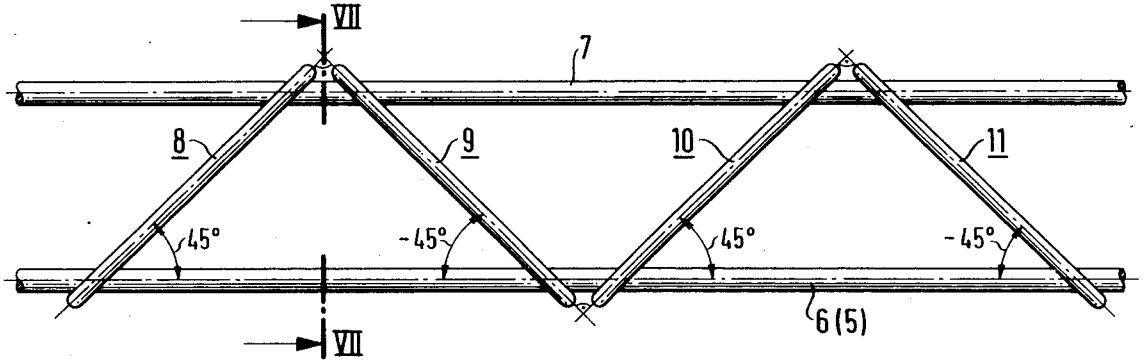
FIG. 6 is a side elevation of the lattice girder shown in FIG. 5.
Figure 7:
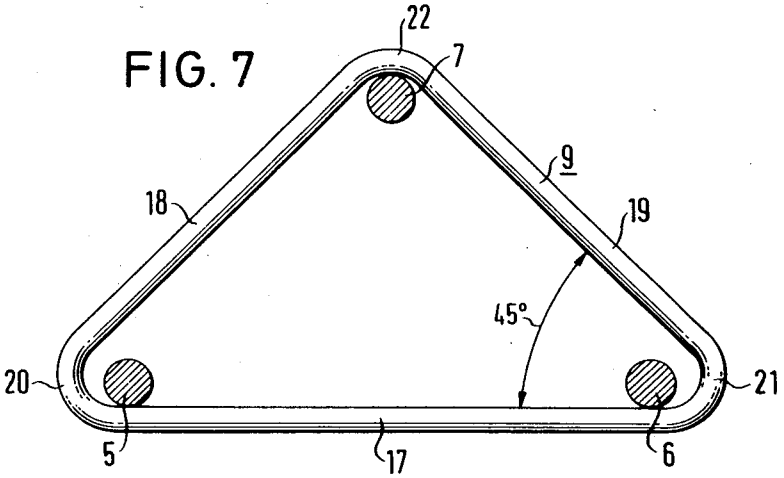
FIG. 7 is a front end view of the lattice girder shown in FIGS. 5 and 6.

FIG. 4 shows an example of connecting members 26. This connecting member is approximately circular in top plan view and has two diametrically opposed, inwardly extending recesses 27 and 28 which end in longitudinal holes 29 and 30 extending transversely of the recesses and thus defining a central web 31. Of course, the connecting members 26 are elastic, and one side 17, 18, 19 each of the ties to be interconnected first is introduced into one of the recesses 27 and 28 and subsequently the connecting member 26 is turned so that the leg 17, 18, 19 will come to lie in the oblong hole 29 or 30. FIGS. 5 to 7 show a second preferred variant of the invention. The chords 5, 6, and 7 are arranged in the same manner as with the embodiment shown in FIG. 1. The ties 8, 9, 10, and 11, however, in this case are embodied by bent integral wire links of the shape of a triangle. The corners 20, 21, and 22 of the ties are rounded so that the points of the triangles are "dissociated". The center axes of the upwardly directed legs (e.g. 18 and 19) of ties (e.g. 8 and 9 or 10 and 11) whose points (22) are adjacent constitute the side edges of the pyramids. In the top plan view of FIG. 5 these center lines 32 and 33 intersect at an angle of 90°. The point of intersection is located above the top chord 7 and exactly above the center line 3.

In the same manner the center lines 33 and 36 or 32 and 37 of the legs of ties 9 and 10 intersect at angles of 90°, the point of intersection each being outside of the lattice girder. The bases of ties 9 and 10 also extend in parallel and spaced from each other, the spacing of the bases of ties 9 and 10 corresponding to the spacing of the "point" of the ties 8 and 9. If the points of intersection of lines 32 and 37 as well as 33 and 36 are joined by a line 38 and if lines 34 and 39 are drawn in parallel with this line as well as vertical lines 40 and 41 passing through the points of intersection mentioned, then these lines constitute the edges of the pyramid. A first pyramid consequently has the following surfaces: a first surface defined by lines 32, 33, and 34, the tie 8 lying in this plane. A second pyramid surface is defined by lines 32, 33, and 38, the tie 9 lying in this plane. The third surface is defined by lines 32, 33, and 40, one leg edge of ties 8 and 9 lying in the plane thus formed. Finally the fourth side is defined by lines 32, 33, and 41, the other legs of ties 8 and 9 lying in this plane. The basis of the pyramid is defined by lines 34, 38, 40, and 41. It is obvious, that all pyramid surfaces are identical.

The ties 9 and 10 form a pyramid which is positioned headdown with respect to the pyramid described above. The basis of this other pyramid is defined by lines 39, 40, 41 and another line 42, extending parallel to line 39 and being determined by the "point" of the tie 10. The pyramid surfaces suitable for a side connection are defined by lines 32 and 37 and a line 35 which is disposed above the plane of the drawing and extends parallel to the center line 3. The other surface is defined accordingly by lines 33 and 36 as well as the other line mentioned.

The lattice girder according to FIG. 5 is seen in a side elevational view in FIG. 6. This view shows the arrangement of ties 8, 9 . . . at alternating angles of +45° and −45° with respect to the chords 6 and 7 as well as the right angle between adjacent ties 8 and 9, 9 and 10, or 8 and 11. Again it is shown clearly that the points of the triangles formed by the ties are dissociated so that the axes of the ties intersect "outside" of the lattice girder.

FIG. 7 is a front end view or a sectional elevation along line VII—VII in FIG. 6. The tie 9 shown consists of an integral bent wire whose free ends are connected in a butt-weld joint. In the view according to FIG. 7 (projection into the sectional plane VII—VII) the base angles between the legs 17 and 18 or 18 and 19 are 45°, while the angle between the legs 18 and 19 is 90°. It can be proved mathematically that these angles (in projection) result if a triangle having a base angle of atn $\sqrt{2}$ and an acute angle of 180−2xatn $\sqrt{2}$ is tilted by 45° (in accordance with FIG. 6). FIG. 7 further shows that the lower chords 5 and 6 are offset inwardly with respect to the corner of the triangles by a certain spacing, whereas the upper chord 7 lies in engagement with the inside of the tie 9 at its apex. The radii of curvature at the corners of the triangle are so selected that the same distance results between the points of adjacent triangles (e.g. 8 and 9 in FIG. 5) and between the bases of adjacent triangles (e.g. 9 and 10 in FIG. 5).

Figure 8:
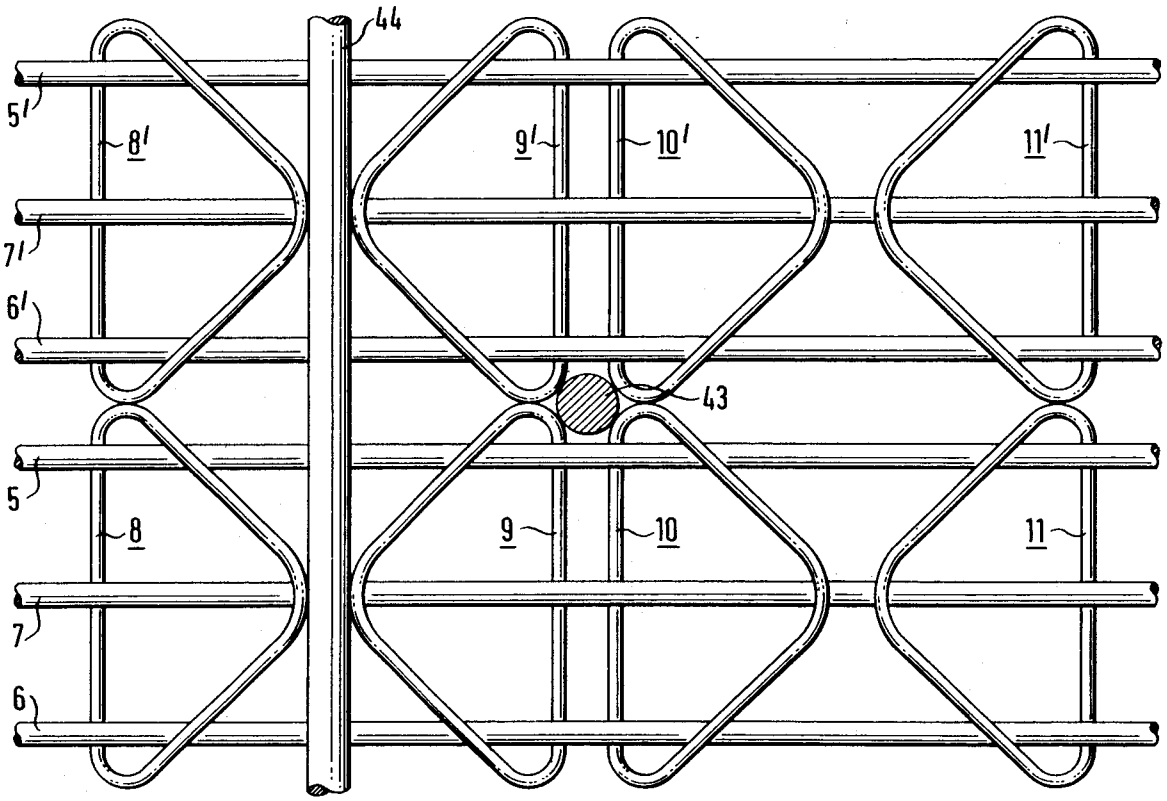
FIG. 8 is a top plan view, similar to FIG. 5, showing two lattice girders side by side in a plane.

FIG. 8 shows two lattice girders disposed in parallel in a top plan view similar to FIG. 5. The chords 5, 6, 5', and 6' lie in one plane, while the chords 7 and 7' lie in another parallel plane disposed above the first one. Adjacent ties, e.g. 8 and 8', 9 and 9', 10 and 10', as well as 11 and 11' are contiguous. The radii of curvature at the bases of the triangles and the spacing of the lower chords from the corners of the triangles provide "free" space in the embodiment of FIG. 8 between adjacent corners of the ties 9, 9', 10, 10'. A vertical bar 43 may be inserted through this free space. The bar may provide support for the lattice structure from below or be used for suspending the lattice structure from the ceiling in the manner of a pulling element. Furthermore, the adjacent lattice girders may be interconnected by transverse bars 44. The transverse bar 44 shown in FIG. 8 rests on chords 7 and 7' and is positioned in the spacing at the points of adjacent ties 8' and 9' or 8 and 9. Instead of bar 43 a similar transverse bar might be used which then would interconnect chords 5', 6', 5, and 6 and extend parallel to the bases of the triangles 9' and 10' as well as 9 and 10.

In this manner, for instance, disconnected ceiling structures may be formed for suspension of such elements as illuminating bodies, loudspeakers, or the like.

Figure 9:
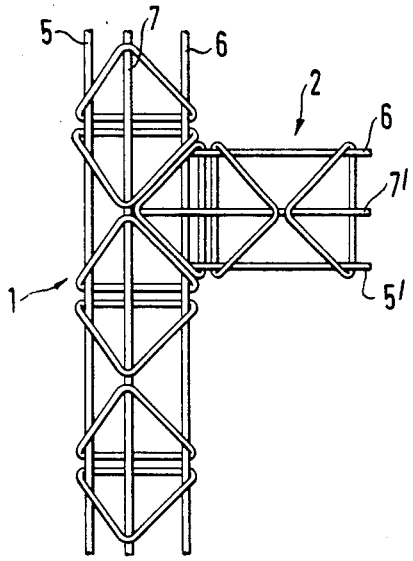
FIG. 9 is a perspective diagram from the top of a side connection between two lattice girders according to FIGS. 5 to 7.

FIG. 9 is a perspective view obliquely from the top of a lateral connection of two lattice girders 1 and 2 with the embodiment shown in FIGS. 5 to 7 and similar to the presentation of FIG. 1. The front end surface of the lattice girder 2 is connected to a "pyramid surface" of the lattice girder 1.

Figure 10:
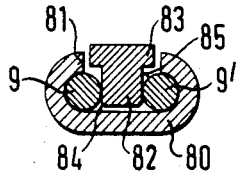
FIG. 10 is a cross section of a first variant of a connecting member.
Figure 11:
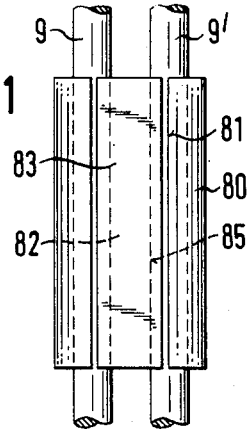
FIG. 11 is a top plan view of the connecting member of FIG. 10.

FIGS. 10 and 11 show a connecting member according to a first basic variant with which adjacent ties are braced by clamping members. In this case two opposed parallel portions of ties 9 and 9' are to be connected. The connecting member 80 used is an approximately oval body having an opening 81 at one side. The width of this opening 81 corresponds at least to twice the diameter of the tie 9 or 9'. The connecting member 80 also may be conceived as a plate having its two lateral edges bent upwards in the same direction at a circular radius of curvature, the radius of curvature of the inside being adapted to the radius of the ties 9 or 9'.

For joining, the ties 9 and 9' first are placed close together so that they may be introduced together through the opening 81. Then they are moved laterally apart. Subsequently a wedge piece 82 is pushed between the two ties 9 and 9' so as to press them apart until they engage laterally with the upwardly bent sides (inner corners) of the connecting member. The wedge piece 82 may have a T-shaped cross-section, as shown in FIG. 10, the transverse bar 83 thereof closing the opening 81. The lower edges 84 of the wedge piece may be slightly chamfered. Otherwise the effective wedge surfaces 85 of the wedge piece extend in parallel so as to guarantee safe retention. The width of the wedge piece 82 is slightly greater than the free distance between the two ties 9 and 9' so that material will be deformed, thereby warranting perfect clamping of the individual component parts. The wedge piece 82, for instance, may be pressed into place by tongs or pliers. The connecting member 80 and the wedge piece 82 may be made of steel. However, it is also possible to make only the connecting member 80 of steel, while the wedge piece 82 is made of plastics.

The basic variant of a connecting member as shown in FIGS. 10 and 11 is the preferred embodiment according to the invention because it is easy to produce and mount and its appearance is esthetic. The connecting member according to FIGS. 10 and 11 is the least conspicuous in finished shelving as compared to the variants to be described below.

Figure 12:
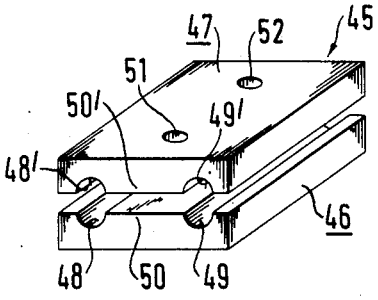
FIG. 12 is a perspective view of a second variant of a connecting member.
Figure 13:
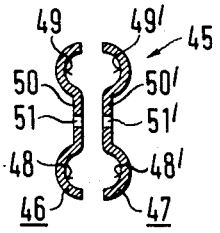
FIG. 13 is a sectional view of a third variant of a connecting member.

FIGS. 12 and 13 show two connecting members of another basic variant with which adjacent ties are braced or screwed together by clamping members. In both cases connecting members 45 are used which are composed of two members 46 and 47 of a shape of mirror symmetry. Both members each have two recesses 48 and 49 or 48' and 49' adapted to the outline of the ties and positioned opposite each other. A central portion 50 or 50' and the other part 51' are formed with through bores 51 and 52 which are aligned with each other. Screws or rivets may be inserted through these bores to connect the two members 46 and 47 in order that the ties to be connected will be held between the recesses 48 and 48' or 49 and 49'.

Another basic variant of mutual fastening is shown in FIGS. 14 to 19 and 23, 24, and 26. With this variant embodiment practically plate-shaped connecting members are positioned at the "pyramid surface" and the opposed plates are interconnected, for instance by screws, by welding or by a bayonet-type connection. FIG. 17 shows a face-end connection (similar to FIG. 2). The two face-end ties 9 and 9' are provided with plates 53 and 54 which in this case project beyond the ties 9 and 9' toward the front end and, for instance, rest on the ties, as clearly shown in FIG. 18. In this case the plates 53 and 54 are hexagons having their outer edges adapted to the outline of the ties 9 and 9'. The hexagons are so positioned that the chords 5, 6, and 7 are not covered. As may be taken from the face-end projection of FIG. 18, the plates 53 have a central recess 55, in this case a circular recess (being an ellipse in projection), and the recesses of both plates 53 and 54 are disposed opposite each other. In the case of the embodiment shown in FIGS. 17 to 19 the two plates 53 and 54 are threadedly engaged only by way of this recess 55, using a threaded sleeve as shown in FIG. 19. This threaded sleeve 56 has a basic body 57 and an outside thread 58 whose diameter is so adapted to the recess 55 that the threaded sleeve will pass through the recess 55. The basic body 57 has a central bore 59 which permits the passing of a cable or the like through the connection. At its end the basic body 57 is formed with a continuous collar 60 which enters into engagement with one of the plates 53 and 54 when establishing the screw connection. The final fixing is effected by a threaded nut 61 which is screwed on to the outside thread 58 until it abuts the other plate 54 or 53, respectively, thereby interconnecting the two plates.

This variant embodiment shows another advantage of the invention. The connection at the front ends with which the parts to be connected are disposed at an angle of 45° with respect to the center axes of the lattice girders requires no special fixing of the two lattice girders in the direction of rotation about their center axes. Rather, the "stable" position results upon loading of the frame even if both center axes lie in one plane and include an angle of 90°.

Figure 16:
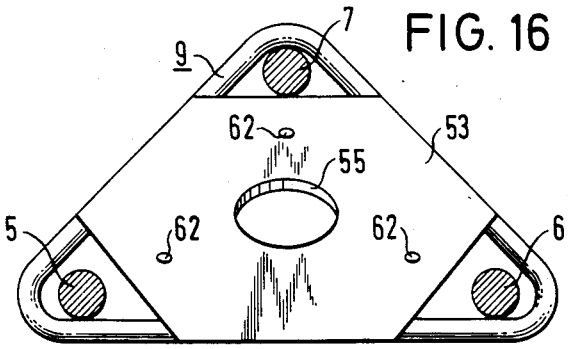
FIG. 16 is a front end view of a (face-end) connecting surface.
Figure 23:
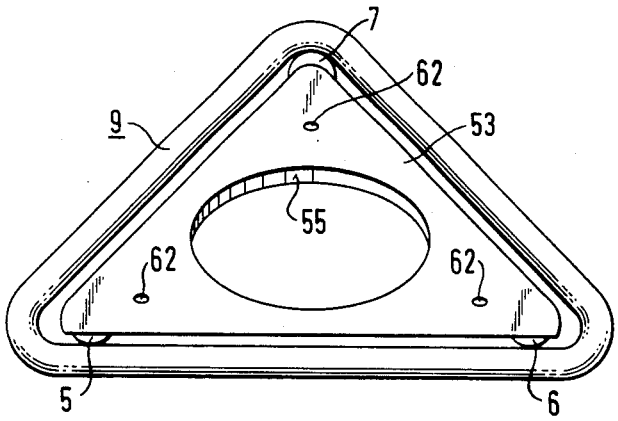
FIG. 23 is a front end view of another variant of a connection.

Instead of this connection, it is also possible to use a face-end plate 53 of the type shown in FIGS. 16 or 23. In FIG. 16 again the plate is a hexagon having a central circular recess 55. However, in this case additional holes 62 are provided for a screw connection so that contacting plates each may be connected by three bolts. In the case of FIG. 16, too, the plate rests on the end face of the tie 9. The chords 5, 6, and 7 are not covered. The variant embodiment shown in FIG. 23 comprises a triangular plate 53 having a central recess 55 and three holes 62 for establishing a screw connection. This plate 53 rests only on the chords 5, 6, and 7 and may be welded to the same, while it does not cover the tie 9.

A lateral connection or, more accurately, a connection between the front end of one lattice girder and the side of a second lattice girder, using the basic concept of the plate is shown in FIGS. 14, 15, 24, and 26. The lattice girder whose front end face is to be connected comprises a plate of the kind shown in FIGS. 16, 18 or 23. Another plate 63 is also mounted at the side surface of the other lattice girder to which the first lattice girder is to be joined. This plate 63 also has a central recess 64 corresponding to the recess 55 of plate 53. The connection can be made by the variant including the threaded sleeve according to FIG. 19 or holes 65 or 62 for screw connection, as shown in FIGS. 16 and 23.

Figure 14:
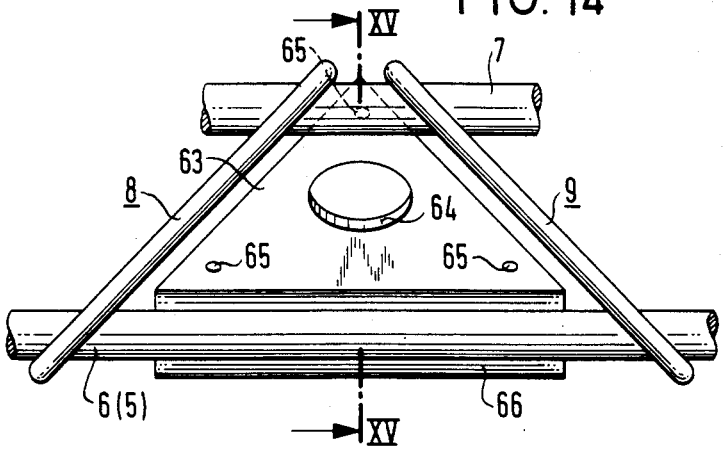
FIG. 14 is a side elevation of a lateral "connecting surface"

In the embodiment according to FIG. 14 the plate 63 is inserted into the triangle defined by the ties 8 and 9. The plate is a triangle whose upper point rests on the chord 7. The base of this triangle, on the otherhand, backs the lower chord 5 by means of a lug 66 bent at an angle, as clearly shown in FIG. 15. By using this backing lug 66 a weld joint may be dispensed with at this location and yet the plate 63 is secured against tensile forces and prevented from being pulled out. However, with the embodiment according to FIGS. 14 and 15 it is recommended that the upper point be welded to the chord 7.

In accordance with another variant (not shown) the lug 66 may be dispensed with and in that case the lower edge is welded to the chord 5.

Another variant, likewise not shown, comprises a triangular plate which rests on the outside of the ties 8 and 9 according to FIG. 14 and is connected to them by welding.

Figure 24:
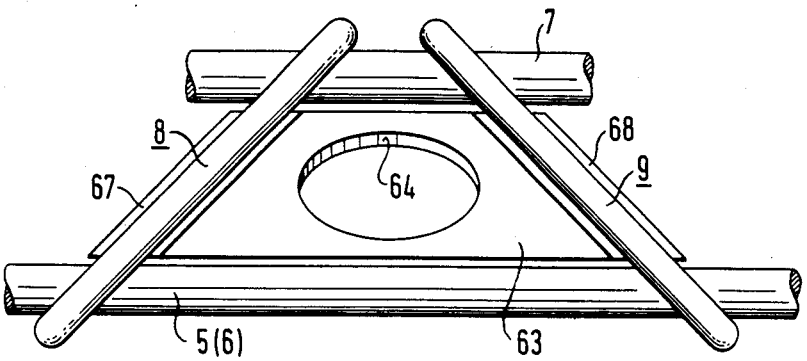
FIG. 24 is a side elevation of another variant of a lateral connection.

FIG. 24 shows yet another embodiment with which a plate 63 has two lateral lugs 67 and 68 both backing the ties 8 and 9. In this case, of course, the plate 63 does not cover the chord 7. On the other hand, however, it may be extended in downward direction to such an extent that it covers the chord 5. This is possible because the chord 5 or 6 is offset inwardly with respect to the corners of the ties 8 or 9 so that the plate 63 may engage in the free space thus formed.

Figure 15:
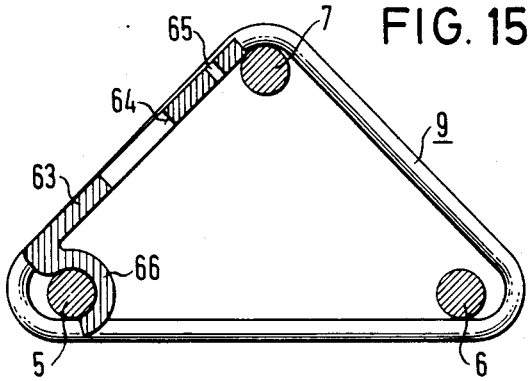
FIG. 15 is a section along lines XV—XV in FIG. 14.
Figure 26:
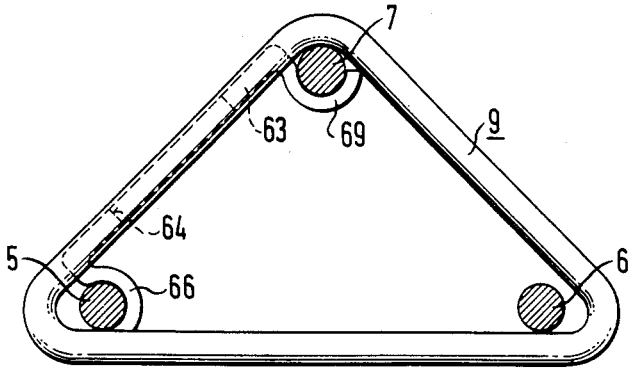
FIG. 26 is a front end view of another variant of a lateral connection.

FIG. 26 shows a modification of the embodiment according to FIGS. 14 and 15. In this case also the upper end of the plate 63 is formed with a lug 69 to back the upper chord 7.

Instead of a threaded connection those embodiments including a fastening plate may be secured by a bayonet-type connection made in the central recesses 55 or 64. One of the two recesses then will be formed with corresponding bayonet recesses (not shown), while bayonet projections will be connected by welding to the other recess. This has the disadvantage of having to keep two different types of plates in store.

Another basic variant of the fastening is shown in FIGS. 20, 21, 22, and 25. This variant embodiment provides for the use of ties instead of a plate. These ties are positioned in parallel with those ties which are to be connected to other ties. These additional ties are spaced from the "principal ties" so that screws may be introduced into the spacing.

Figure 20:
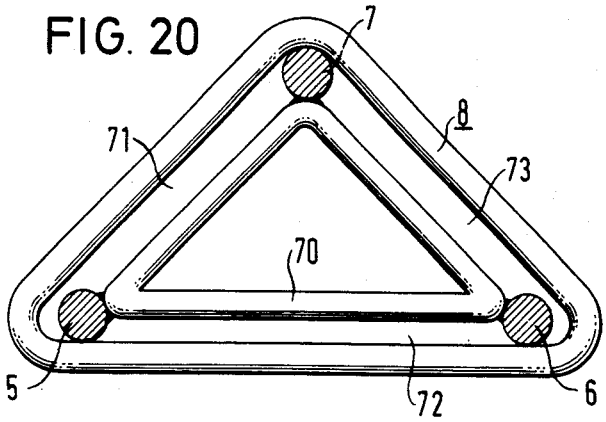
FIG. 20 is a front end view of a "connecting surface" according to another embodiment of the invention.
Figure 21:
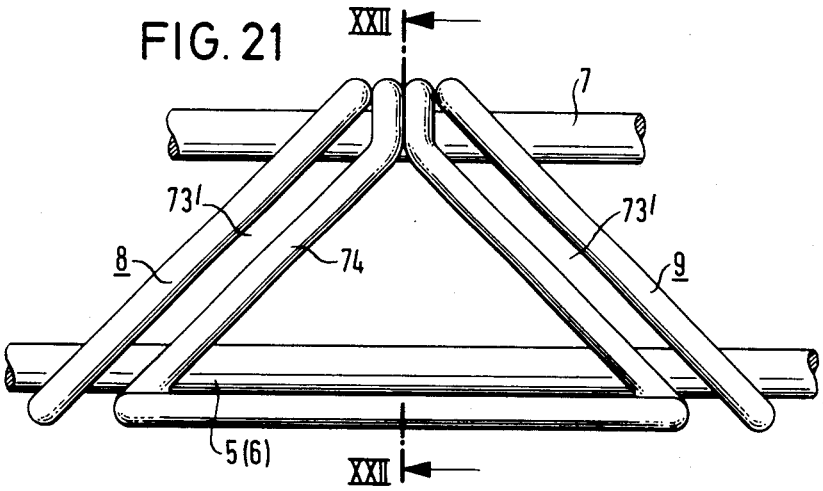
FIG. 21 is a side elevation of a lateral connecting surface according to another embodiment of the invention.
Figure 22:
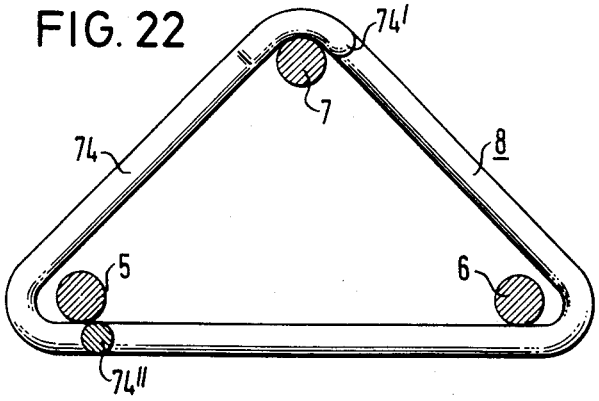
FIG. 22 is a section along line XXII—XXII in FIG. 21.

An example of a front end connection is shown in FIG. 20. A tie 70 positioned in congruent relationship with the tie 8 at the face end has its three outwardly directed corners welded to the chords 5, 6, and 7. This tie 7 has the same angles as the tie 8 but smaller dimensions so that it fits exactly into the "interior" of the tie 8 or of the chords 6 and 7. The tie 70 is located in the same plane as the tie 8. In this manner spaces 71, 72, and 73 are formed between the legs of the inner tie 70 and of the outer tie 8. Screws may be passed through these spacings and they may be supported by washers or apertured plates on the legs of the ties 70 and 8, thereby interconnecting two identical face ends of two lattice girders, as shown in FIG. 20. A variant embodiment for lateral connection is shown in FIGS. 21 and 22. Here a triangular tie 74 is so inserted into the "triangle" defined by the ties 8 and 9 that again a spacing 73' (similar to spacing 73 in FIG. 20) is formed between the tie 74 and the ties 8 and 9. The tie 74 is bent at an angle at the top and bottom, as may be seen at its ends 74' and 74'' (FIG. 22). These ends 74' and 74'' partly back the chords 5 and 7 and are connected to the chords by welding. The two legs of 7 the tie 74 extending obliquely upwardly are disposed in parallel with the upwardly extending legs of the tie 70 of FIG. 20. The ties 8 and 9 of FIG. 21 extend parallel to the tie 8 of FIG. 20. The basic leg of the tie 74, however, extends parallel to the basic leg of the tie 80 of FIG. 20. The spacings 73' of FIG. 21 lie above the spacings 71 and 73 of FIG. 20 so that screws may be inserted. The screw heads or washers will be positioned at the back side of the ties 70 and 8 or 9 and 74 as well as 8 and 74. In this manner the fastening is accomplished.

Figure 25:
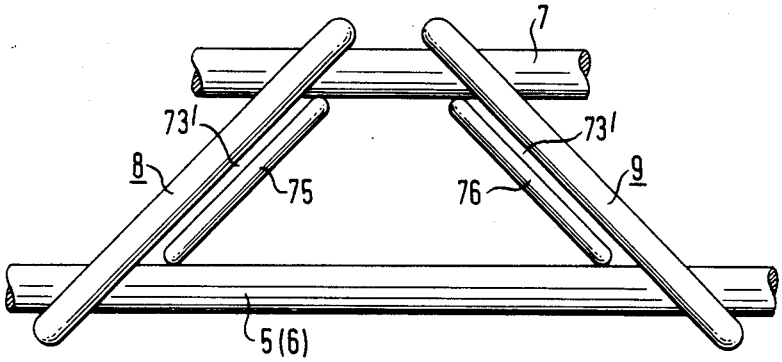
FIG. 25 is a side elevation of another variant of a lateral connection.

The tie 74 according to FIG. 21 may be replaced by inner ties 75 and 76 similar to the ties 17 according to FIG. 20, as shown in FIG. 25. These inner ties 75 or 76 extend in parallel with the outer ties 8 and 9 and again spacings 73' (corresponding to FIG. 21) are formed, as seen in side elevation. The ties 75 and 76 are covered by the inner ties 70 at the front end, as shown in FIG. 20. In the embodiment according to FIG. 25 the ties 75 and 76 are not positioned in the same plane as the ties 8 and 9. Therefore, the washers must be of corresponding shape to balance this offset.

In accordance with another variant (not shown) the embodiment according to FIG. 25 may be provided with inner ties 75 and 76 which differ from the inner ties 70 of FIG. 20 only in that their obliquely upwardly extending legs are extended to such a point that they are positioned parallel to the legs of the tie 8 of FIG. 20. Ties of such configuration may have a "dip" at each of their threecorners, in analogy to the lugs 68 and 69 shown in FIG. 26.

Figure 27:
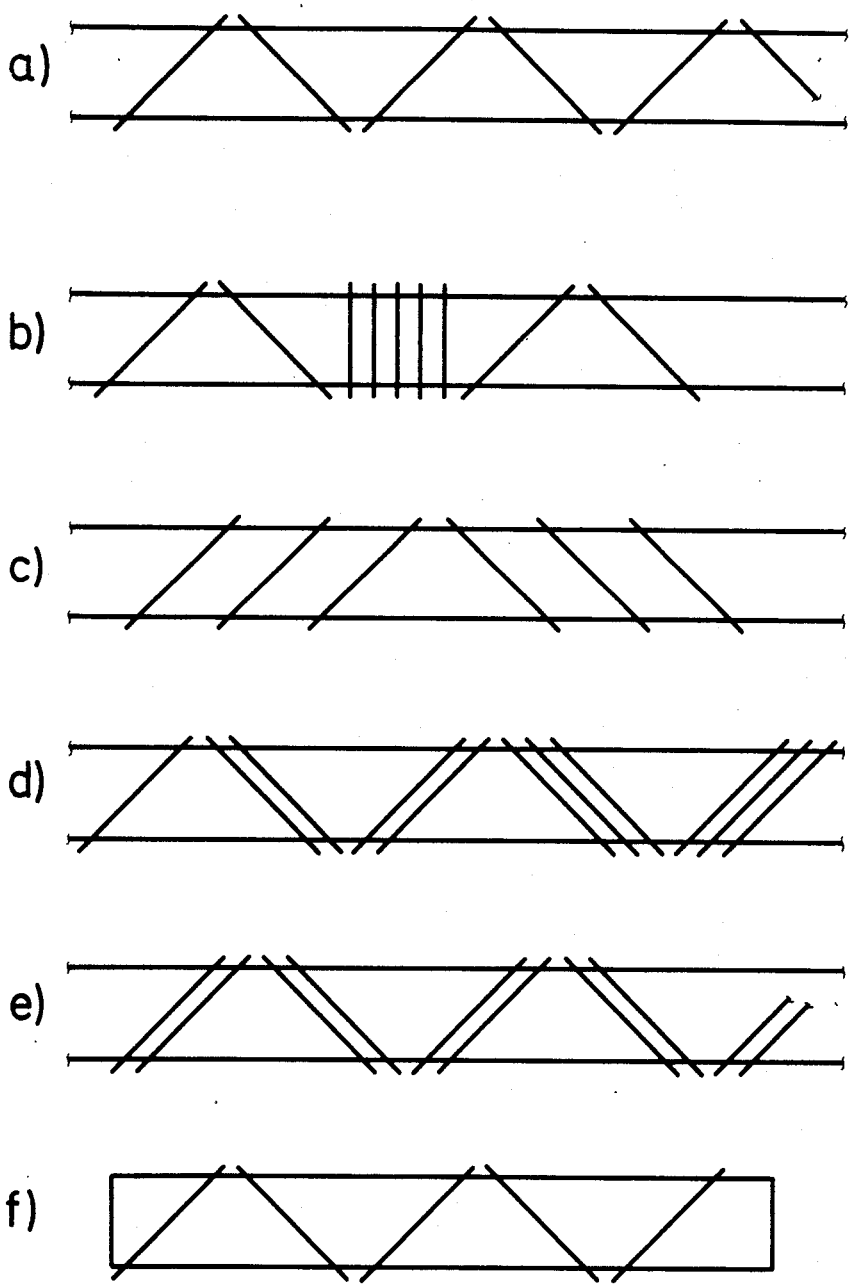

FIG. 27 shows a variety of diagrammatic side elevations to demonstrate possible arrangements of ties connecting the girders. FIG. 27*a* shows the basic embodiment with which the ties are inclined alternatingly at angles of +45° and −45°.

FIG. 27*b* shows that some ties also may be positioned at right angles with respect to the longitudinal axis.

FIG. 27*c* shows that groups may be formed of parallel ties, having only one "angular change".

FIG. 27*d* shows how alternating groups of parallel ties may have a different number of parallel ties where the angular change is made.

FIG. 27*e*, on the other hand, shows the same number of ties forming a tie group.

FIG. 27*f* shows that vertical ties may be placed also at the front ends. In this case, of course, it is not possible to make a connection at the front end.

Figure 28:
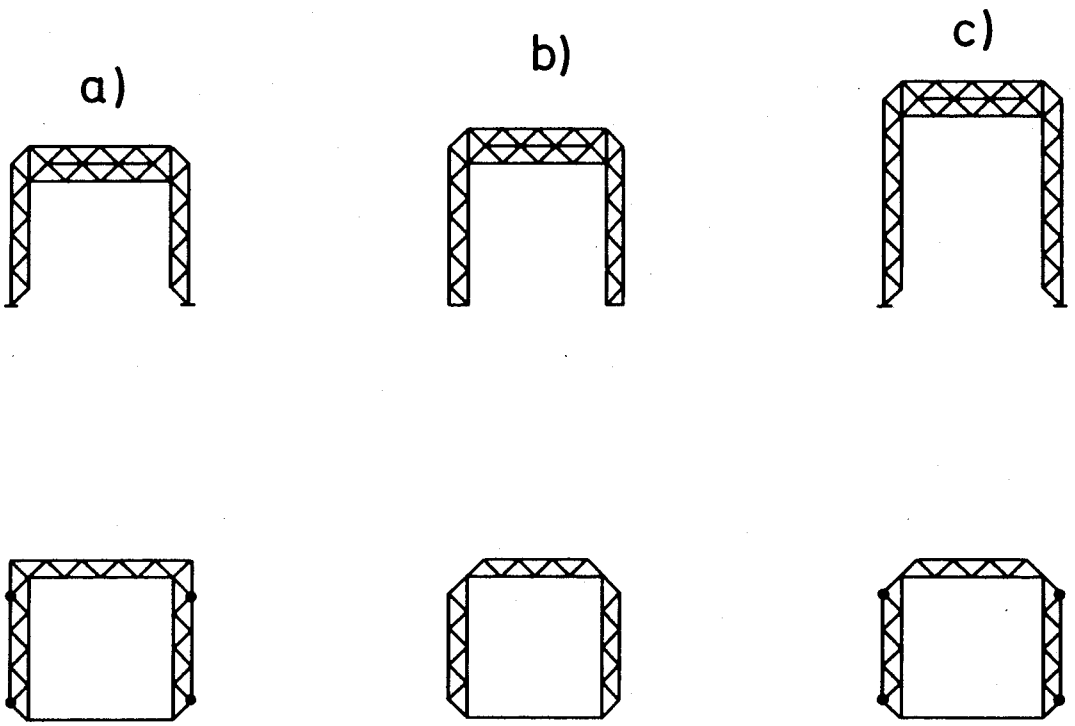
Figure 28:
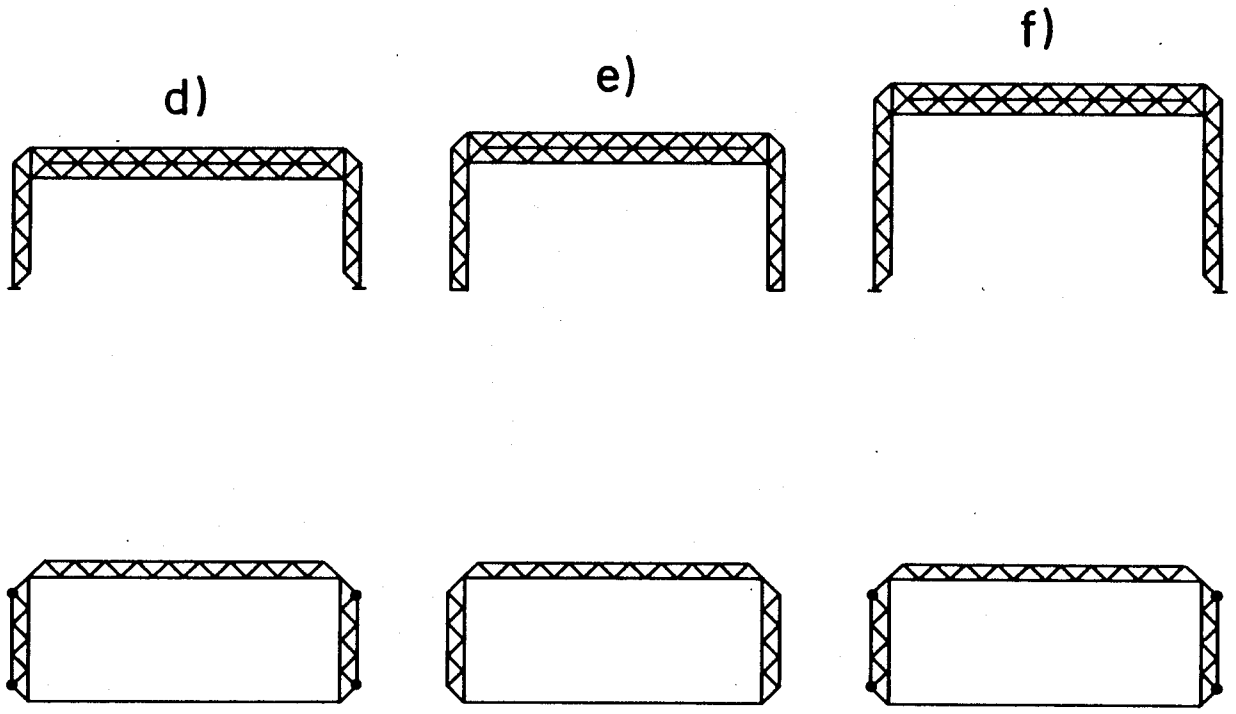
Figure 28:
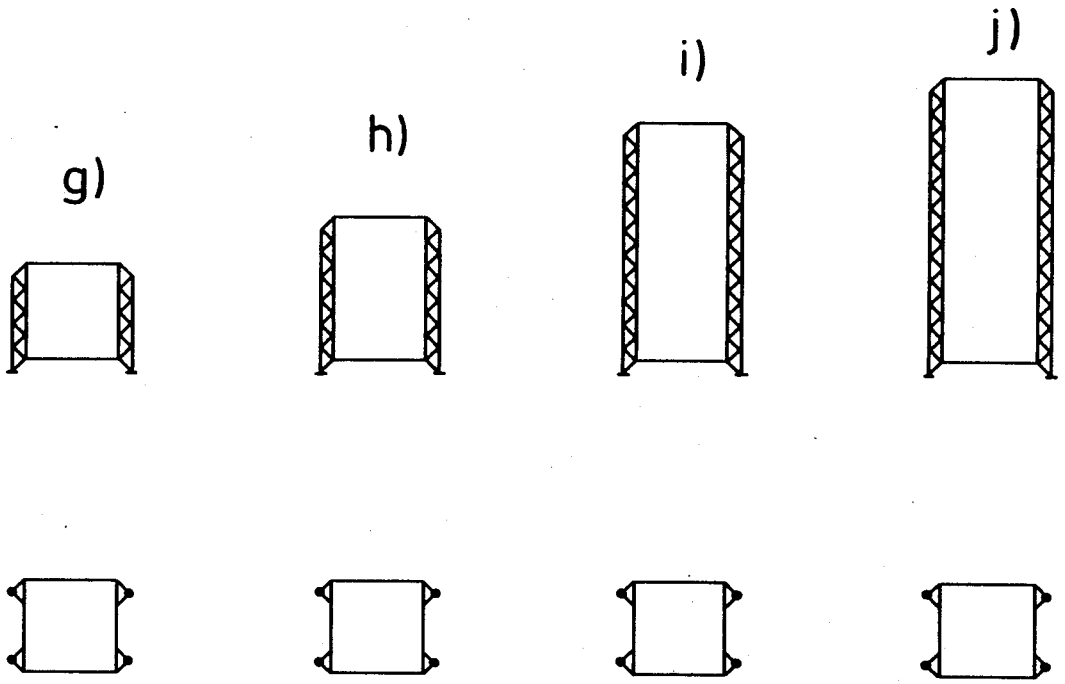
Figure 28:
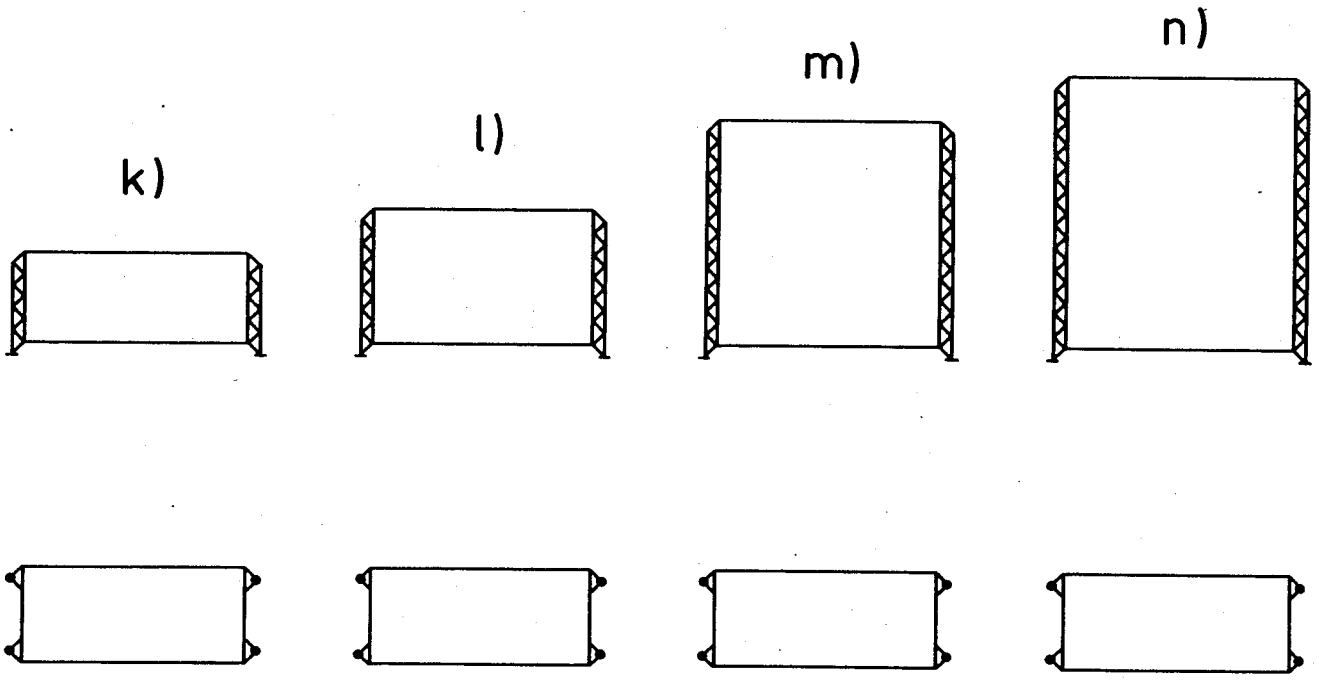

FIG. 28 shows a series of top plan views and side elevations of different possibilities of application of the frame system according to the invention, such as tables and partitions. The frame system also may be used for decoration, being designed in the form of a desk storage bin. To this end a pyramid-shaped block of corresponding dimensions and angular inclinations may be inserted into the free spaces within the individual lattice girders, and it may have recesses or bores to take up desk utensils. A desk storage bin of such design is both decorative and convenient.

All the technical details presented in the claims, specification, and drawing may be essential of the invention both individually as well as in any desired combination.

What is claimed is:

1. A frame system, in particular for racks and interior fixtures, comprising:

at least two elongate lattice girders, each having a longitudinal axis, each lattice girder having three elongate member not located in the same plane; said member being interconencted by closed triangles, said triangles encompassing said members on the outside, each said triangle of a said girder extending in a plane with the planes of adjacent triangles intersecting at approximately 45° relative to said longitudinal axis of said respective girder; each said triangle having base angles of approximately 54.74° and an apex angle of approximately 70.53°, said triangles being spaced along each said respective girder with adjacent triangles alternately having their apexes in juxtaposition and sequentially their bases in juxtaposition, each said triangle having corners with said corners being rounded and each said triangle having three legs with axis of said legs intersecting externally of said legs of said triangle, each said triangle having a base leg with said base legs of said triangles being spaced apart from one another along said respective girder, a said elongate member being disposed adjacent a corner of each said triangle with said elongate members adjacent said respective base angles being spaced slightly inwardly of said respective corners of said triangles, said frame system including connecting means for permitting connection between said elongate lattice girders with said longitudinal axes of said girders extending at right angles to one another and with said connecting means cooperating with said triangles to permit one of said lattice girders to be disposed in one of three planes relative to the other said lattice girder.

2. The frame system as claimed in claim 1 wherein said triangles are made of bent wire which is butt-welded at its ends.

3. The frame system as claimed in claim 1 wherein said connecting means comprises connecting members which embrace the adjacent legs of adjacent triangles of said girders, said connecting means further including a wedge piece for pressing the legs against the connecting member in connecting said two lattice girders.

4. The frame system as claimed in claim 3, characterized in that the wedge piece (82) is T-shaped in cross section, and in that its transverse bar (83) has a width which corresponds to the width of the opening (81) formed in the connecting member (80).

5. The frame system as claimed in claim 1 wherein said triangles are adapted to be screw connected by connecting members embracing the legs to connect said two lattice girders.

6. The frame system as claimed in claim 5, characterized in that the connecting members (45) comprise two members (46,47) of mirror symmetry including recesses (48,48';49,49') which are located opposite each other to receive portions of the triangles, and at least one hole (51,52) in the central portion (50,50') for taking up a screw.

7. The frame system as claimed in claim 1 wherein a plate is inserted and fixed to adjacent triangles of said respective girders that are to be connected together, said plates being interconnected.

8. The frame system as claimed in claim 7, characterized in that the plates have a central circular recess (55) and are interconnected by a threaded sleeve (56) passing through these recesses.

9. The frame system as claimed in claim 8, characterized in that the threaded sleeve (56) has a central bore (59).

10. The frame system as claim 7 characterized in that the plate (53,54,63) is triangular, positioned parallel to a plane defined by a face-end triangle (9), and fixed to the face ends of the members (5,6,7) by welding.

11. The frame system as claim 7 characterized in that the plate (53) is triangular, rests on a face-end triangle (69), and is connected to the same, by welding.

12. The frame system as claimed 7 characterized in that the plate (53) is hexagonal and fixed to portions of a face-end triangle, leaving free the face ends of the members (5,6,7) (FIG. 18).

13. The frame system as claims; 7, 13 characterized in that the plate (63) for lateral connection is a triangle form which the point is cut off and which backs parallel legs of adjacent triangles (8,9) by a lateral lug (67,68) each (FIG. 24).

14. The frame system as claimed in claim 1, characterized in that the plate (53,54,63) has threading holes (62) through which screws are passed to interconnect two plates.

15. The frame system as claim 1, characterized in that two, inner triangles (75,76) are provided parallel to the adjacent triangles (8,9) at a spacing (73') for a lateral connection, the spacing (73') serving to pass connecting screws (FIG. 25).

16. The frame system as claimed in claim 15, characterized in that the upwardly directed legs of the inner triangles (75,76) lie in the same plane as the associated legs of the triangles (8,9) the point of the inner triangles (75,76) each having a dip adapted to the shape of the upper chord (7).

17. The frame system as claimed in claim 15, characterized in that the inner triangles (75,76) are offset inwardly with respect to the outer triangles (8,9) in face-end projection, the washers used for the screws being asymmetrical to account for this offset.

18. The frame system as claimed in claim 1 wherein each said girder has a face-end connection comprising an inner triangle which lies in the same plane as said face-end of each girder and is shaped in congruence with said face-end, said inner triangle having corners which are connected to said elongated members and spaces being formed between the legs of said face-end triangle and an outer triangle through which connecting screws are passed.

19. The frame system as claimed in claim 1 wherein a further triangle is provided for lateral connection which triangle is inserted at a spacing from the legs of adjacent triangles, and the apex and base of which are fixed to associated elongated members.

* * * * *